US011375319B2

(12) United States Patent
Foletta et al.

(10) Patent No.: US 11,375,319 B2
(45) Date of Patent: Jun. 28, 2022

(54) TABLETOP MICROPHONE ASSEMBLY

(71) Applicant: Plantronics, Inc., Santa Cruz, CA (US)

(72) Inventors: Wayne Stanley Foletta, San Martin, CA (US); Yanling Wang, Beijing (CN); Hui Luo, Beijing (CN)

(73) Assignee: PLANTRONICS, INC., Santa Cruz, CA (US)

( * ) Notice: Subject to any disclaimer, the term of this patent is extended or adjusted under 35 U.S.C. 154(b) by 0 days.

(21) Appl. No.: 17/121,171

(22) Filed: Dec. 14, 2020

(65) Prior Publication Data

US 2021/0306761 A1 Sep. 30, 2021

Related U.S. Application Data

(60) Provisional application No. 63/002,181, filed on Mar. 30, 2020.

(51) Int. Cl.

| | |
|---|---|
| ***H04R 19/04*** | (2006.01) |
| ***H04R 1/22*** | (2006.01) |
| ***H04R 1/04*** | (2006.01) |
| ***H04R 19/00*** | (2006.01) |

(52) U.S. Cl.

CPC ..... *H04R 19/04* (2013.01); *H04R 1/04* (2013.01); *H04R 1/222* (2013.01); *H04R 19/005* (2013.01); *H04R 2201/003* (2013.01)

(58) Field of Classification Search

CPC combination set(s) only.

See application file for complete search history.

(56) References Cited

U.S. PATENT DOCUMENTS

| | | | | |
|---|---|---|---|---|
| 78,155 A | | 3/1978 | Botros | 179/1 CN |
| 4,078,155 A | | 3/1978 | Botros et al. | 379/369 |
| 5,881,156 A | * | 3/1999 | Treni | H04R 1/406 381/91 |
| 16,346 A | | 1/2000 | Rittmueller | 379/420 |
| 6,016,346 A | | 1/2000 | Rittmueller et al. | 379/420.02 |

(Continued)

FOREIGN PATENT DOCUMENTS

| | | | | |
|---|---|---|---|---|
| CN | 103472898 A | * | 12/2013 | |
| CN | 107564521 A | * | 1/2018 | |
| JP | 2014 171108 | | 9/2014 | H04R 1/02 |

(Continued)

OTHER PUBLICATIONS

International Search Report and Written Opinion, Application No. PCT/US2021/023803, 15 pages, dated Jun. 28, 2021.

(Continued)

*Primary Examiner* — Angelica M McKinney

(74) *Attorney, Agent, or Firm* — Slayden Grubert Beard PLLC

(57) ABSTRACT

A tabletop microphone assembly is provided that exhibits improved spatial audio pick-up characteristics, for example for use as an extension microphone for a conference system. In one embodiment, the tabletop microphone assembly comprises at least a housing with a top cover and a bottom cover, wherein the bottom cover is configured for placement on a table surface; a printed circuit board, arranged in the housing; and a microphone, arranged between the printed circuit board and the bottom cover; wherein the microphone is facing the bottom cover.

19 Claims, 12 Drawing Sheets

(56) References Cited

U.S. PATENT DOCUMENTS

| | | | | |
|---|---|---|---|---|
| 2011/0226544 | A1* | 9/2011 | Viehmann | H04R 29/004 181/198 |
| 2017/0105066 | A1* | 4/2017 | McLaughlin | H04R 3/005 |

FOREIGN PATENT DOCUMENTS

| | | | | |
|---|---|---|---|---|
| JP | 2014171108 | A | 9/2014 | H04R 1/02 |
| WO | 99 46956 | | 9/1999 | H04R 1/34 |
| WO | 99/46956 | A1 | 9/1999 | H04R 1/342 |

OTHER PUBLICATIONS

Search Report for International Application No. PCT/US2021/023803, 15 pages, dated Jun. 28, 2021.

* cited by examiner

TABLETOP MICROPHONE ASSEMBLY

CROSS-REFERENCE TO RELATED APPLICATION

This application claims priority to U.S. Patent Application No. 63/002,181, filed on Mar. 30, 2020 with the United States Patent and Trademark Office. The contents of the aforesaid Patent Applications are incorporated herein for all purposes.

FIELD

The present disclosure relates generally to microphones. More particularly, the present disclosure relates to tabletop microphones.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

In the field of audio and videoconferencing, microphones are widely used to pickup audio of conference participants. So-called extension microphones are used to extend the audio pickup capabilities of a primary conferencing device.

For example, a table-based assembly may include one or more installed microphones for picking up room audio and in particular speaking participants of an audio or video conference. Alternatively, assemblies in the form of a video bar may include one or more installed microphones for picking up room audio and the speaking participants.

An issue that some of these devices exhibit is that the sensitivity of audio pickup of the microphones may be non-uniform, such that participants at a given distance and a first angle from the used microphones may be heard better than, for example other participants at the same distance but at other angles from the used microphones. This issue may be caused by a non-uniformity of the microphone's polar pattern and/or the overall assembly with respect to amplitude. Another issue that may be present is significant frequency variation over the microphone's polar pattern.

SUMMARY

Based on the shortcomings of the prior art, an object exists to provide a tabletop microphone assembly that exhibits improved spatial audio pick-up characteristics. The object is solved by the subject matter of the independent claim(s). Embodiments of the invention are discussed in the dependent claims and the following description.

In a first exemplary aspect, a tabletop microphone assembly is provided that comprises at least: a housing with a top cover and a bottom cover, wherein the bottom cover is configured for placement on a table surface; a printed circuit board, arranged in the housing; and a microphone, arranged between the printed circuit board and the bottom cover; wherein the microphone is facing the bottom cover.

In another exemplary aspect, a conference system is provided that comprises at least one or more tabletop microphone assemblies.

The details of one or more embodiments are set forth in the accompanying drawings and the description below. Other features will be apparent from the description, drawings, and from the claims.

DESCRIPTION

Figure 1:
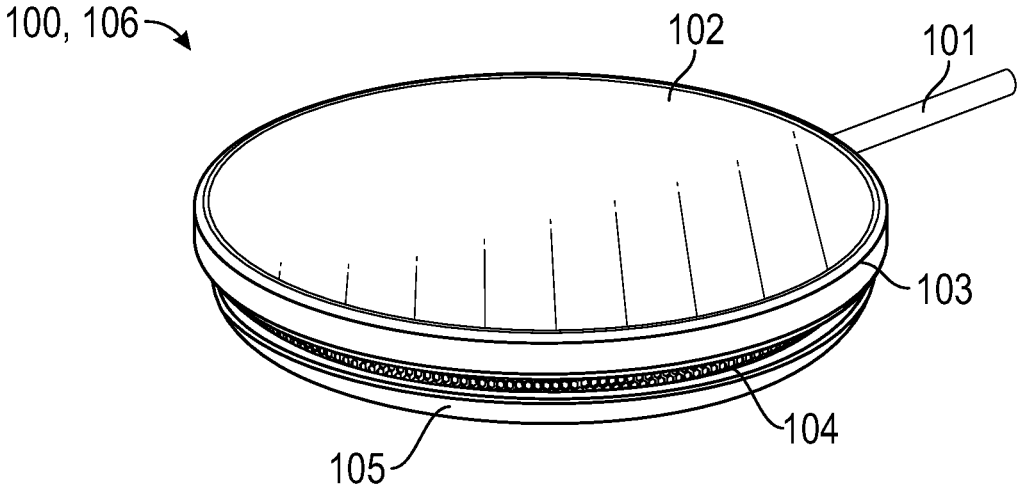
FIG. 1 shows an embodiment of a tabletop microphone assembly in a perspective schematic view.

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following explanation of the present invention according to the embodiments described, the terms "connected to" or "connected with" are used to indicate a data, video, and/or audio (signal) connection between at least two components, devices, units, processors, circuits, or modules. Such a connection may be direct between the respective components, devices, units, processors, circuits, or modules; or indirect, i.e., over intermediate components, devices, units, processors, circuits, or modules. The connection may be permanent or temporary; wireless or conductor based; digital or analog.

For example, a data, video, and/or audio connection may be provided over a direct connection, a bus, or over a network connection, such as a WAN (wide area network), LAN (local area network), PAN (personal area network), BAN (body area network) comprising, e.g., the Internet, Ethernet networks, cellular networks, such as LTE, Bluetooth (classic, smart, or low energy) networks, DECT networks, ZigBee networks, and/or Wi-Fi networks using a suitable communications protocol. In some embodiments, a USB connection, an I2C connection, a HDMI connection, a HDCI connection, a Bluetooth network connection, a Wi-Fi connection, and/or a LAN connection is used to transmit video, audio and/or data.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

In a first exemplary aspect, a tabletop microphone assembly is provided. The tabletop microphone assembly comprises at least: a housing with a top cover and a bottom cover, wherein the bottom cover is configured for placement on a table surface; a printed circuit board, arranged in the housing; and a microphone, arranged between the printed circuit board and the bottom cover; wherein the microphone is facing towards the bottom cover.

In the present context, the term 'tabletop microphone assembly' is understood as a microphone assembly that is adapted to be placed on a flat surface, for example a table surface, such as a conference table, desk or countertop. The tabletop microphone assembly in some embodiments may be adapted to be used as a (separate) part of an audio conference system or video conference system, such as for a meeting room. The tabletop microphone assembly may be particularly suitable to pick-up voice or speech of, e.g., one or more conference participants in the meeting room. The tabletop microphone assembly of this aspect may be configured to be temporarily or permanently installed on the table surface, so that audio of its surroundings may be captured. It is noted that herein, the terms 'meeting room', 'conference room', 'huddle room', 'huddle space', 'team room', 'board room', and 'conferencing room' are used interchangeably for a dedicated enclosed space for holding conferences or meeting, usually in a building, structure, or vehicle. A 'video conference (or conferencing) system' as used herein may also be referred to as a 'videotelephony system' or 'telepresence system'.

The microphone assembly according to the present aspect, as mentioned in the preceding comprises a housing with at least a top cover and a bottom cover, wherein the bottom cover is configured for placement on a table surface. The housing may be of any suitable type and may, for example but without limitation, be made from metals, plastics, glass, fiberglass, carbon fiber, anti-microbial material, composite materials, or a combination thereof. The top cover and the bottom cover may be shaped as desired for the respective application. In some embodiments, the bottom cover comprises one or more feet, provided on an exterior side of the bottom cover, i.e., the side that in use is facing the table surface.

While in some embodiments, the top cover and the bottom cover may be formed integrally, such as for example by injection molding, in other embodiments, the top cover and the bottom cover are formed separately from each other. In these embodiments, the top cover and the bottom cover may be mounted to each other using any suitable means, such as fasteners, glue, welding, ultrasonic welding, adhesive tape, snap-fit, etc. without limitation. The housing may in some embodiments have a suitable design to allow sound to reach the microphone, for example one or more openings, holes cutouts, perforations, membranes, grilles, etc.

The microphone assembly according to the present exemplary aspect further comprises at least one printed circuit board (PCB), which is arranged in the housing. The PCB in some embodiments comprises various electronic or electrical components. For example, the PCB may comprise one or more of a battery, a power supply, a microphone amplifier circuit, a phantom power circuit, audio processing circuitry, an A/D converter, one or more sensors (PIR, IR), other discrete components, and a communications interface, such as for example an Ethernet Interface, Bluetooth Interface, an RF transceiver, an IR transceiver, a fiber optics transceiver, and/or a Wi-Fi-Interface.

The microphone in the arrangement according to the present aspect is arranged between the printed circuit board and the bottom cover and is facing towards the bottom cover. Accordingly, the acoustically movable element of the microphone (e.g., its membrane) is facing the bottom cover, i.e., is facing downwards when in use. This arrangement results in beneficial audio characteristics, in particular with respect to the uniformity of the resulting microphone polar pattern and frequency response, as will be explained in more detail in the following. At the same time, the microphone is covered by the PCB and is protected from debris, such as dust, particles, crumbs, etc., which otherwise may deteriorate the performance of the microphone assembly.

The microphone may be of any suitable type. For example, but without limitation, the microphone may be dynamic, condenser, electret, ribbon, carbon, piezoelectric, fiber optic, laser, or MEMS type. The microphone may be omnidirectional in some embodiments. In some embodiments, the microphone is a boundary microphone.

In some embodiments, the microphone is mounted to a first side of the PCB, which first side is arranged so as to face an inside of the bottom cover. In other embodiments, the microphone is mounted to the bottom cover or an interior microphone mount. In these embodiments, the microphone may for example be connected to the PCB using a asymmetric or symmetric audio connection. In some embodiments, multiple microphones are provided. Corresponding additional microphones may be mounted between the PCB and the bottom cover or elsewhere. In some embodiments, multiple microphones are arranged between the PCB and the bottom cover in an arrangement, facing the bottom cover.

In some embodiments, the microphone is arranged at a distance of a maximum of 3 mm from the bottom cover. The present embodiments provide improved sound pickup characteristics, in particular with respect to frequency response due to reduced comb filtering. In some embodiments, the microphone is arranged at a distance of a maximum of 2 mm or a maximum of 1.5 mm from the bottom cover for further improved characteristics.

In some embodiments, the housing is cylindrical and comprises a longitudinal axis, wherein the longitudinal axis being arranged perpendicular to the top cover and the bottom cover. The present embodiments provide a symmetrical arrangement about the longitudinal axis with provides an improved spatial frequency response. In some embodiments, the top cover and/or the bottom cover are disc-shaped. While these embodiments still result in a cylindrical overall shape of the housing, the extension of the housing in the direction of the longitudinal axis is limited.

For even further improved sound pickup characteristics, the microphone in some embodiments may be arranged on the longitudinal axis, which includes setups, where the microphone is offset slightly from the longitudinal axis, but still in its vicinity. In case that multiple microphones are provided, it may be difficult to arrange all of the microphones on the longitudinal axis. Accordingly, all or some of the microphones may be offset from the longitudinal axis. In some embodiments, the arrangement of the microphones with respect to the longitudinal axis is symmetrical.

In some embodiments, the housing further comprises a grille or screen, arranged between the top cover and the bottom cover at a circumference of the cylindrical housing. In some embodiments, the top cover and the bottom cover may be arranged so that a gap is left between the two cover parts at or near the circumference of the cylindrical housing, which gap is at least partly covered by the grille. In some embodiments, one or more of the two cover parts are configured with a circumferential recess or groove, in which the grille is arranged. In some embodiments, the grille is cylindrical. For example, the cylindrical grille may have a radius, that is equal to or less than a radius of the cylindrical housing. In some embodiments, the grille comprises an array of small holes and/or a relatively thin wall.

In some embodiments, the top cover, the bottom cover, and the grille form a transparent acoustical chamber. The term 'transparent' as used herein relates to acoustic transparency. Accordingly, the top cover, the bottom cover, and the grille are configured so that the acoustical characteristics of the chamber minimize polar variations with respect to signal amplitude (sensitivity), phase, and/or frequency response.

In some embodiments, the microphone assembly further comprises a frequency-selective attenuator, arranged on an inside of the bottom cover. The frequency-selective attenuator may be of any suitable type to enhance the acoustic transparency of the assembly. In some embodiments, more than one frequency-selective attenuator is provided. For example, a first frequency-selective attenuator may be arranged on an inside of the bottom cover. In some embodiments, the first frequency-selective attenuator is arranged within the acoustical chamber opposite of the microphone(s) along the longitudinal axis. In some embodiments, a second frequency-selective attenuator or a sealing foam pad is arranged between the PCB and the top cover. In some embodiments, the frequency-selective attenuator is disc-shaped. In some embodiments, the frequency-selective attenuator comprises at least a layer of melamine foam or is entirely made from melamine foam.

In some embodiments, the bottom cover is made from a high density material, such as for example metal. Using a high density material adds weight to stabilize the assembly, e.g., in case of table vibrations. In some embodiments, the microphone is mounted on a first side of the printed circuit board, wherein the microphone assembly further comprises a user interface, arranged on a second side of the printed circuit board, opposite to the first side. The physical separation of the user interface from the microphone provides attenuation of artefacts from a user that operates the user interface. The user interface may be of any suitable type and may comprise one or more electromechanical mechanisms, capacitive touch mechanisms, or other suitable mechanisms. Additionally or alternatively, the user interface may comprise one or more display devices, status lights (LEDs), without limitation. In some embodiments, the user interface comprises at least a mute control that allows the user to selectively (i.e., as desired) mute the at least one microphone when activated. Alternatively or additionally, the user interface may comprise a volume control dial. In some embodiments, the tabletop microphone assembly further comprises a speaker to provide an audio output, e.g., from the conferencing system.

In some embodiments, the microphone assembly is configured as a tabletop microphone pod. In some embodiments, the microphone assembly is configured as an extension microphone for a conference system.

Extension microphones, also referred to as microphone pods, are auxiliary microphone devices that can be communicatively coupled with a primary conferencing system/device to extend and augment the pickup capabilities of the conferencing system. For example, an extension microphone connected to a primary system may be set up a number of feet or yards away from the primary conferencing system, to ensure that conference participants distanced from the primary system can be heard properly during an audio or video conference.

According to another exemplary aspect, a conferencing system is provided with one or more tabletop microphone assemblies as discussed in the preceding. The microphone assemblies may be configured according to one or more of the preceding or following embodiments.

In some embodiments, the conferencing system is a video conferencing system. The video conferencing system in some embodiments further comprises one or more cameras, one or more video playback devices, and/or a network interface for communicating with at least one remote conferencing participant, i.e., someone not in the room where the video conference system is installed.

Reference will now be made to the drawings in which the various elements of embodiments will be given numerical designations and in which further embodiments will be discussed.

Specific references to components, process steps, and other elements are not intended to be limiting. Further, it is understood that like parts bear the same or similar reference numerals when referring to alternate figures. It is further noted that the figures are schematic and provided for guidance to the skilled reader and are not necessarily drawn to scale. Rather, the various drawing scales, aspect ratios, and numbers of components shown in the figures may be purposely distorted to make certain features or relationships easier to understand.

FIG. 1 shows an embodiment of a tabletop microphone assembly in a perspective schematic view, namely an exemplary extension microphone pod 100. The microphone pod 100 may be coupled to a primary conferencing device/system (not shown), enabling the microphone pod 100 to serve as an extension microphone for such a device or system that may, e.g., be placed on a conference table or desk, without limitation.

The microphone pod 100 is of overall cylindrical shape and comprises a housing 106. The housing 106 is shown to include a circular top surface 102, which may define the generally cylindrical overall shape of the housing 106 of the extension microphone pod 100. The top surface 102 provides a user interface, which is discussed in more detail in the following. A bottom surface (not shown in FIG. 1) is adapted to be placed on a surface, such as a conference table or desk and may comprise suitable feet.

A cable connection 101 extends outwardly from a side of the pod 100, which connection 101 is arranged to provide audio, data, and power connections over a 4-wire interface (analog microphone audio with duplexed mute button action, LED status indicator, power, and return ground) between the microphone pod 100 and the conferencing device/system.

A perforated grille or screen 104 is provided around the circumference of the microphone pod 100 between a top cover 103 and a bottom cover 105. In this embodiment, the grille 104 is made of metallic material. As can be seen, the diameter of the circular grille 104 is less than the outer diameter of the top cover 103 and the bottom cover 105, so that a circumferential recess is provided. This results in that debris, present on the top surface 102 or near the bottom cover 105 cannot easily enter the housing 106 through the grille 104. A scrim thus is not necessary, which improves the acoustic characteristics of the microphone pod 100. The outer diameter of the bottom cover 105 is greater than that of the grille 104, however smaller than the diameter of the top cover 103.

In the present embodiment, the top surface 102 of the microphone pod 100 serves as a user interface. Specifically, the top surface 102 is touch sensitive and functions as a mute button, i.e., allows to mute or unmute the microphone pod 100. In addition, an LED status indicator (not shown) is provided to show power and mute states. Certainly, additional or alternative functions may be provided in corresponding embodiments. In the present embodiment, touching the top surface 102 actuates a capacitive touch mechanism to mute or unmute the audio pickup operation of the microphone pod 100.

Figure 2:
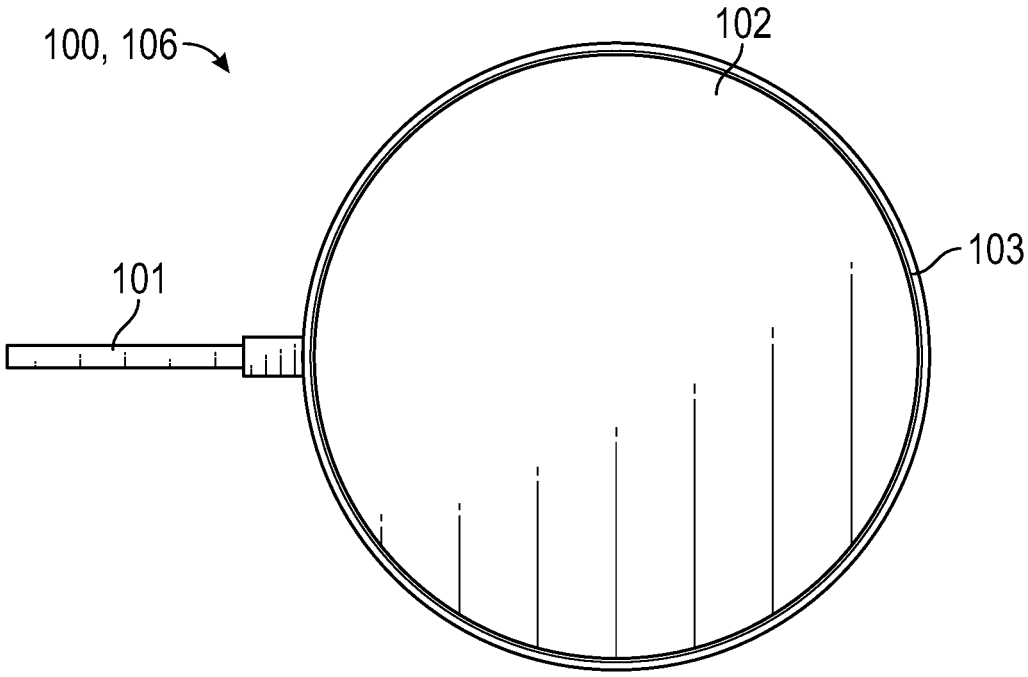
FIG. 2 shows the embodiment of FIG. 1 in a schematic top view.
Figure 3A:
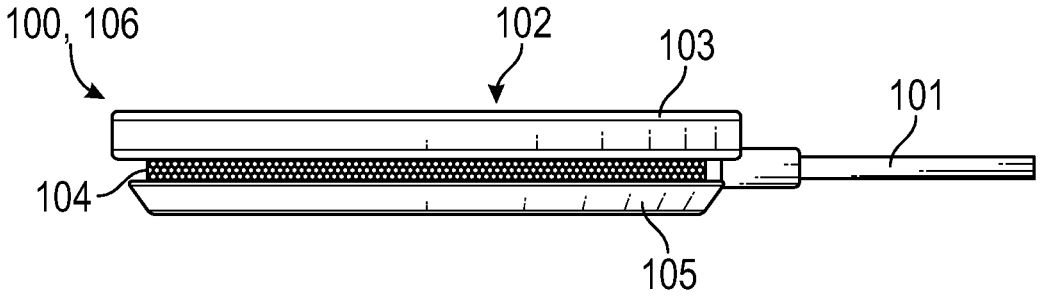
FIGS. 3A-3C show the embodiment of FIG. 1 in schematic side views.
Figure 3B:
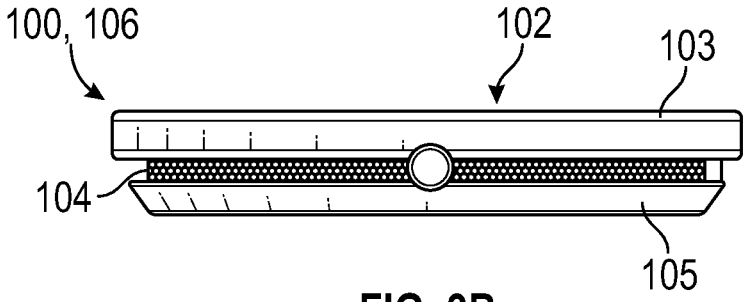
Figure 3C:
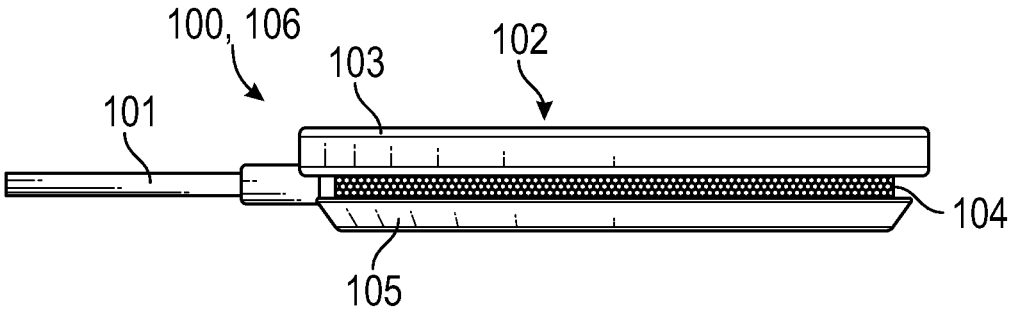

FIG. 2 shows a schematic top view of the microphone pod 100 of the present embodiment, while FIGS. 3A-3C show schematic side views.

The extension microphone pod 100 discussed herein provides for a number of advantages over prior art systems. For example, the extension microphone pod 100 disclosed herein provides for complete 360 degree coverage of talker position around a conference table with little or no frequency and sensitivity response variation.

The microphone pod 100 comprises a MEMS microphone 406 with D/A converter (not shown), which is arranged in an interior acoustical chamber 500. The microphone 406 is mounted 'face down', i.e., so that its membrane faces the bottom cover 105. The microphone 406 is substantially in the center of the microphone pod 100, thereby minimizing polar variations in pickup. Details of the arrangement of microphone 406 will become apparent from FIGS. 4 and 5A, the former of which shows the embodiment of FIG. 1 in an exploded assembly view.

Figure 4:
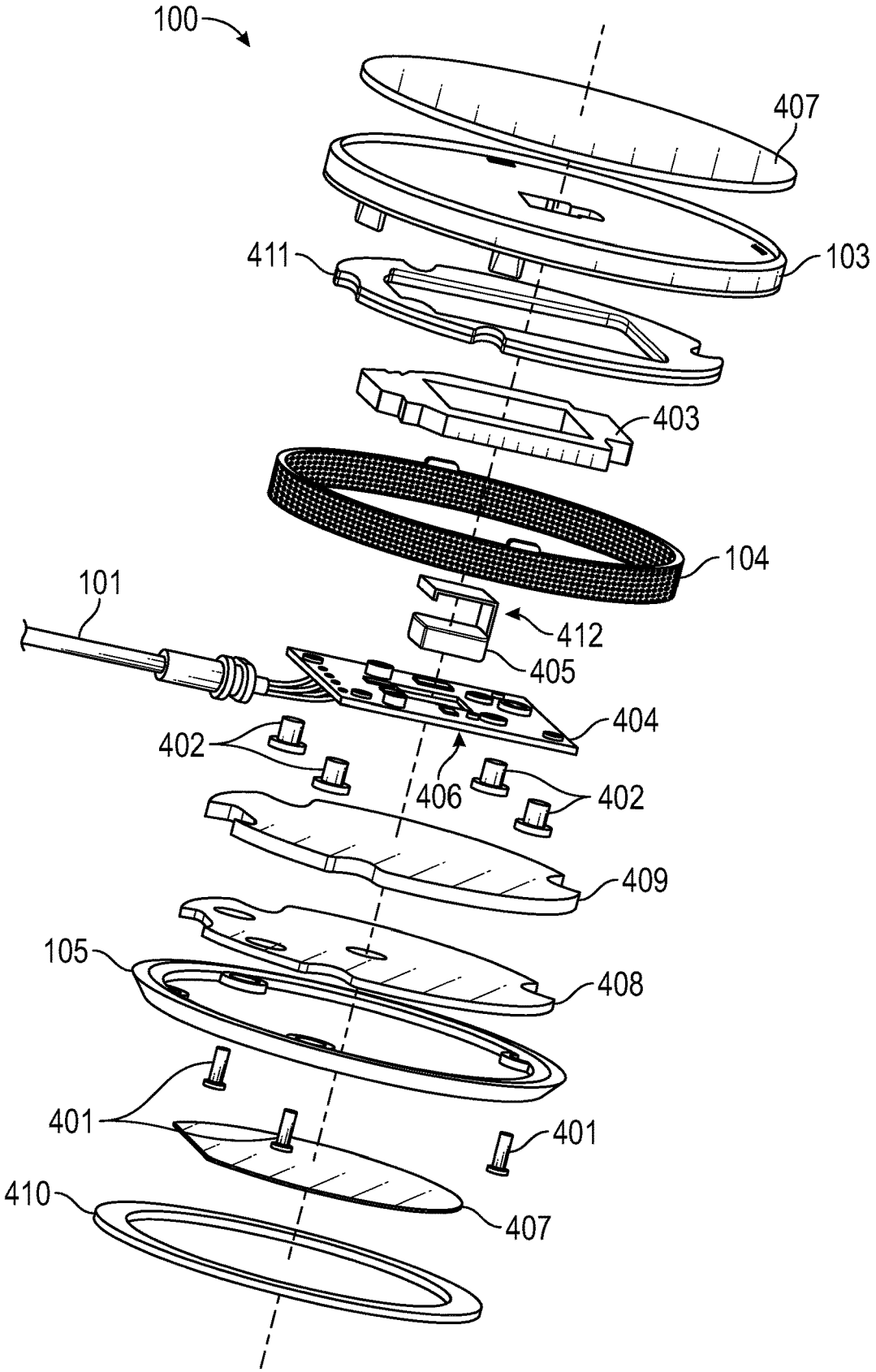
FIG. 4 shows the embodiment of FIG. 1 in an exploded view.

As shown in FIG. 4, the microphone pod 100 may be generally described as a 'two wafer parts design' (top cover 103 and bottom cover 105), separated by the grille 104, i.e., the thin ring of perforated material to define a rigid and transparent acoustical chamber 500 inside of housing 106.

Figure 6:
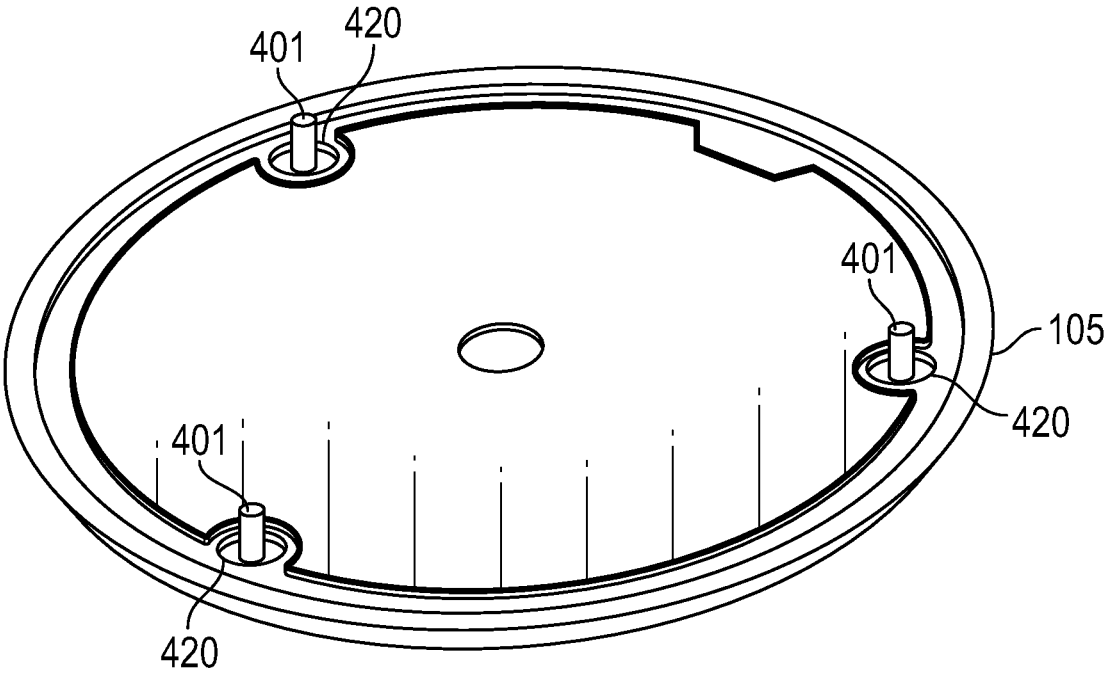
FIG. 6 shows a bottom cover of the embodiment of FIG. 1.
Figure 7:
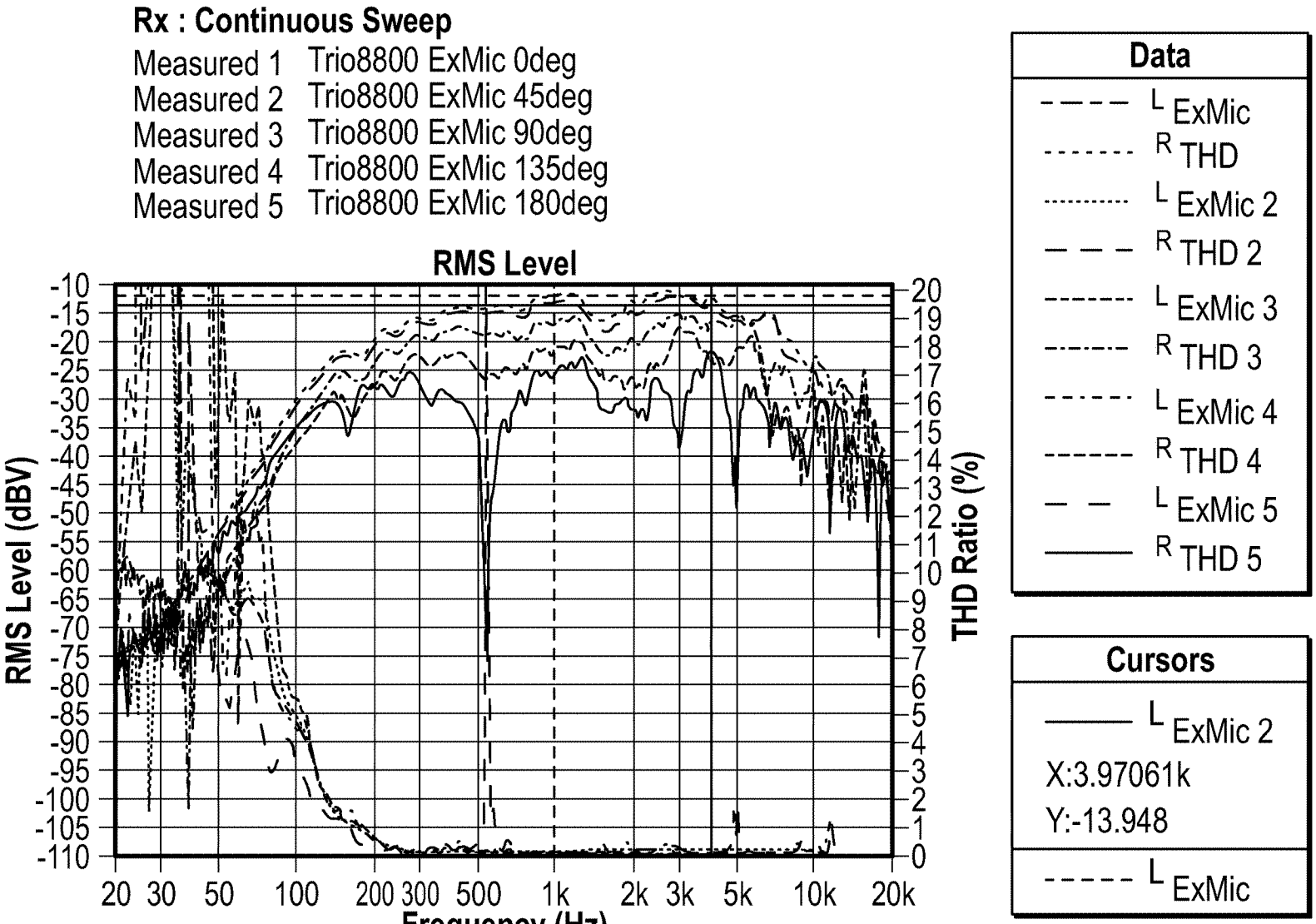
FIGS. 7-11 show various polar diagrams of exemplary tabletop microphone assemblies.
Figure 8:
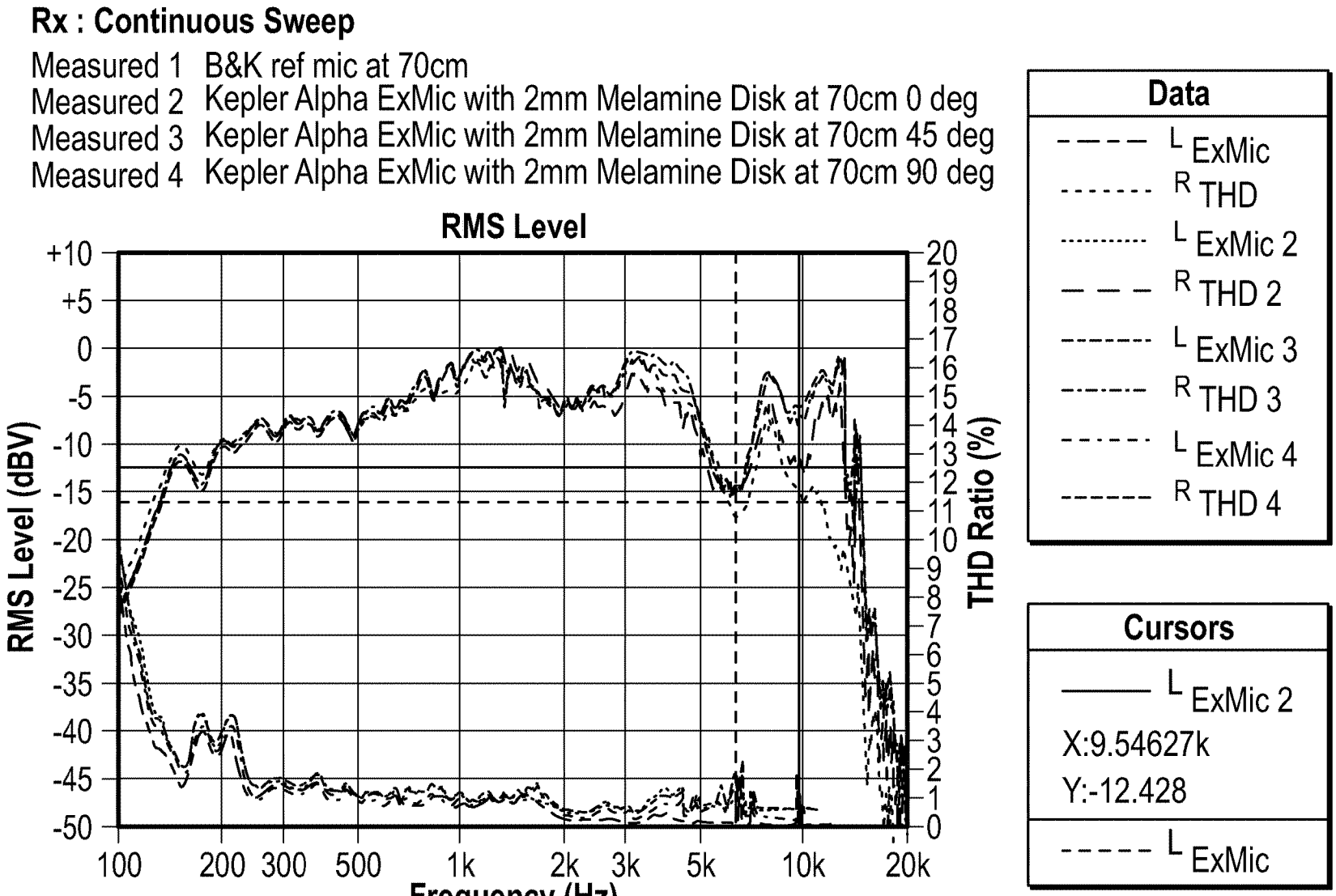
Figure 9:
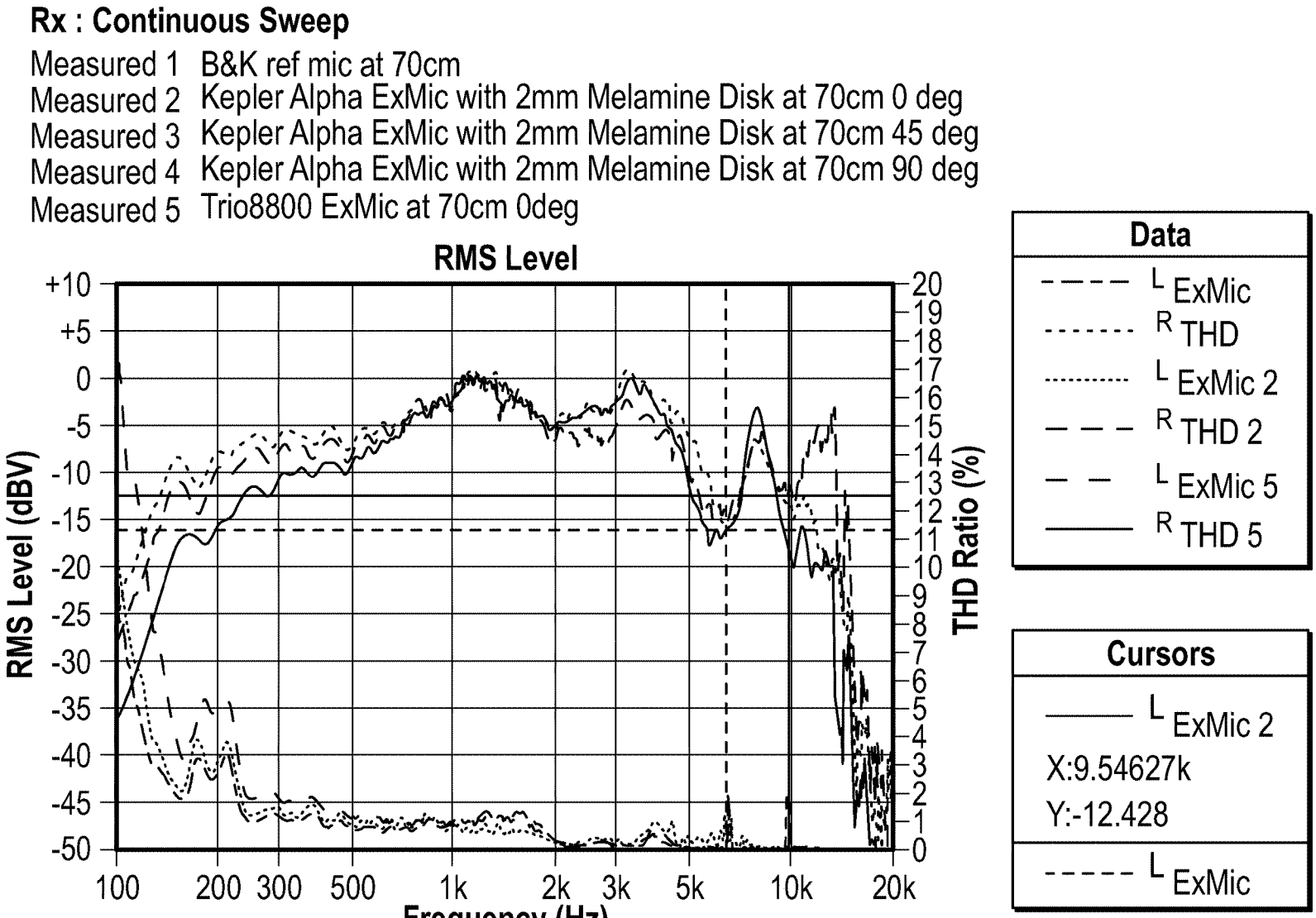
Figure 10:
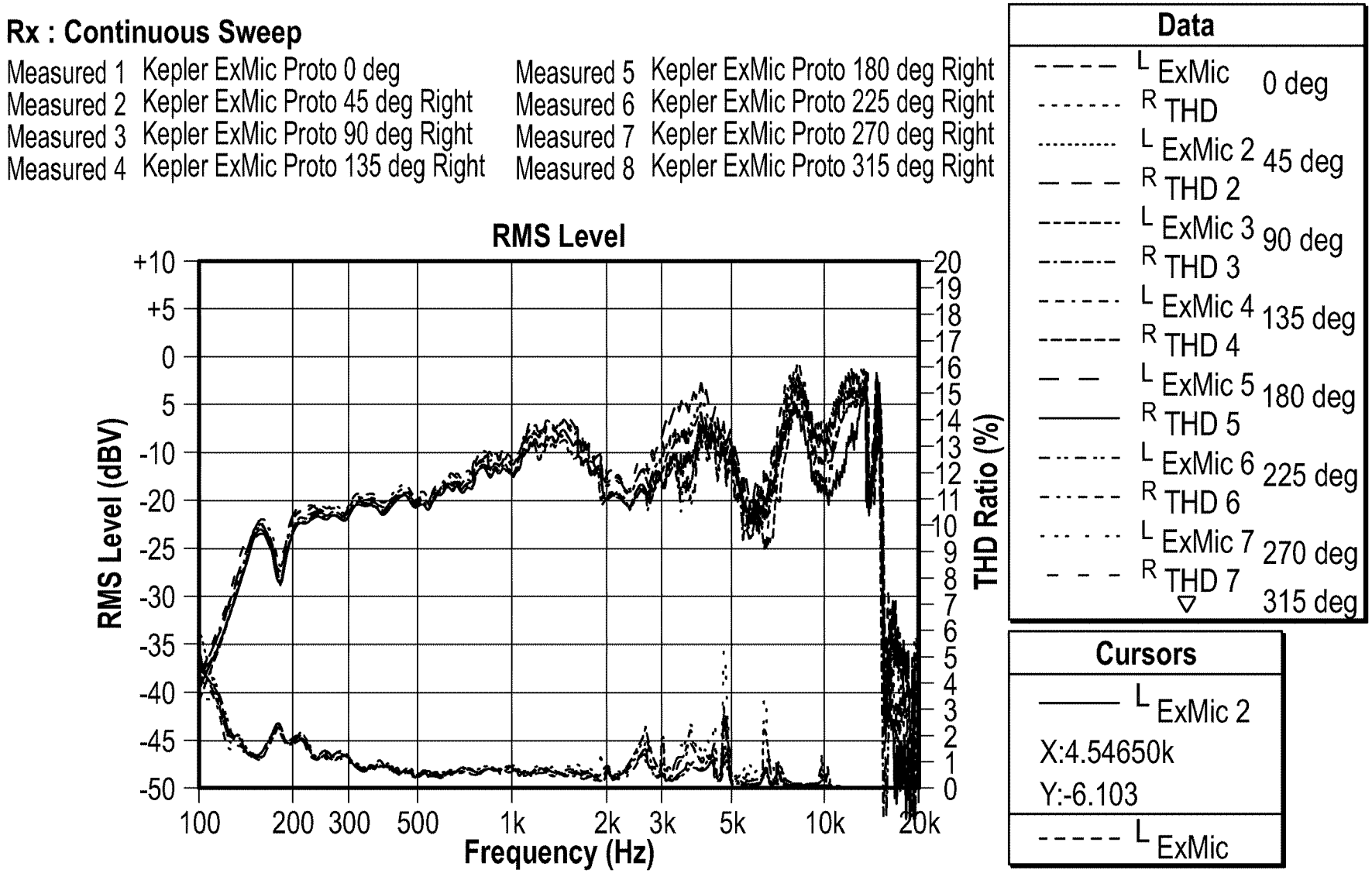
Figure 11:
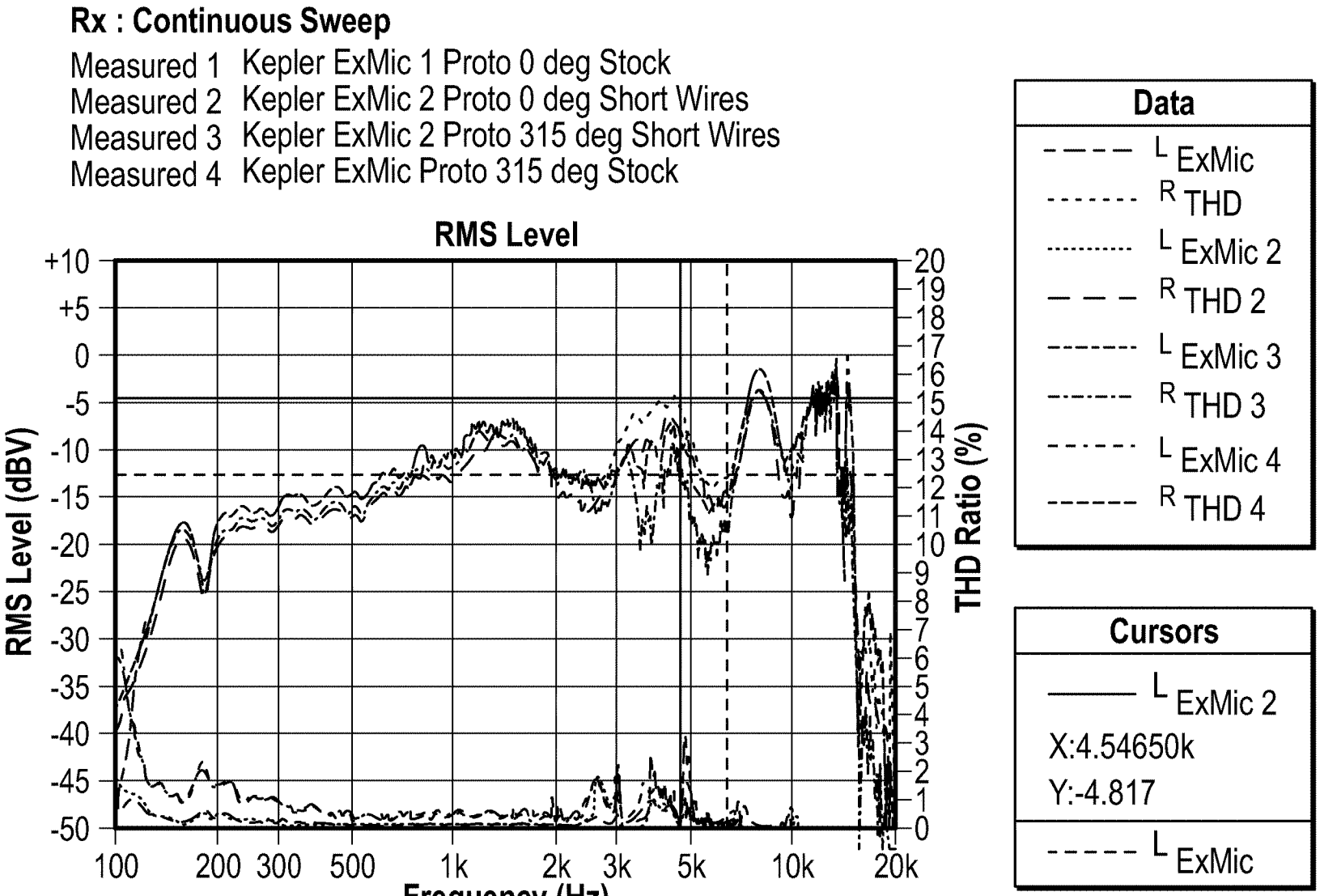

In the present embodiment, the top cover 103 and bottom cover 105 may be fastened together with screw-type fasteners 401 (type: ST1.6*L5.5 mm). Fastening the top cover 103 and bottom cover 105 will also 'clamp down' the grille 104. In the present embodiment, it may be desirable to ensure the radiuses of such screws, and any posts to which they are fastened, are as small as possible to minimize sound shadowing of sound, entering the interior acoustical chamber 500 from the outside before reaching the microphone 406. FIG. 6 shows relatively small diameters of the three mounting posts 420 formed as a part of the bottom cover 105 and located beyond the perimeter of a printed circuit board 404 in the final assembly. The diameter of such posts 420 may be, for example, between 1.5-5 mm.

Alternatively or additionally to the use of screw-type fasteners 401, the top cover 103 and bottom cover 105 may be fastened together by fastening the grille 104 to the covers 103, 105 by glue/adhesive or folding tabs.

Referring again to FIG. 4, the microphone pod 100 includes the printed circuit board assembly (PCBA) 404. The PCBA 404 comprises the MEMS microphone 406 that is mounted on a first side of the PCBA 404, which first side faces the bottom cover 105. Thus, the microphone's sound port through which the MEMS microphone 406 picks up audio, is located on the first (bottom) side of the PCBA 404. A mylar film is provided between MEMS microphone 406 and the PCBA 404 to prevent shorts and block light leakage of the LED to the bottom side.

A second (top) side of PCBA 404 comprises electronics, namely in particular, a power supply circuit, a microphone amplifier with bandpass filter, and auxiliary circuitry. The second side of PCBA 404 also comprises elements of the mentioned user interface. Specifically in this exemplary embodiment, a sub-assembly of mute elastomer 405 and mute touch plate 412, as well as the LED status indicator (not shown) are provided. Mute elastomer 405 reduces audio artefacts from a user operating the mute control, while the mute touch plate 412 is needed for the capacitive coupling of the top surface 102 with respective capacitive-sensing electronics.

The PCBA 404 is mounted to the top cover 103 using further screw-type fasteners 402 (type: ST2.5*3 mm). The fasteners 402 also secure the foam top 403 and the base top cover 411 to the top cover 103. The foam top 403 is closed cell foam and serves as a filler, preventing an unintended resonant air chamber that may otherwise cause deterioration of the audio quality of the microphone pod 100. Logo cover 407 allows to provide a decorative finish and/or user instructions on the top cover 103.

Once the above-mentioned components are fixed to the top cover 103 using fasteners 402, a sub-assembly of top cover 103, logo cover 407, base top cover 411, foam top 403, grille 104, mute touch plate 412, mute elastomer 405, PCBA 404, cable connection 101, and microphone 406 is given. This sub-assembly is shown in the schematic perspective view of FIG. 5A.

Figure 5A:
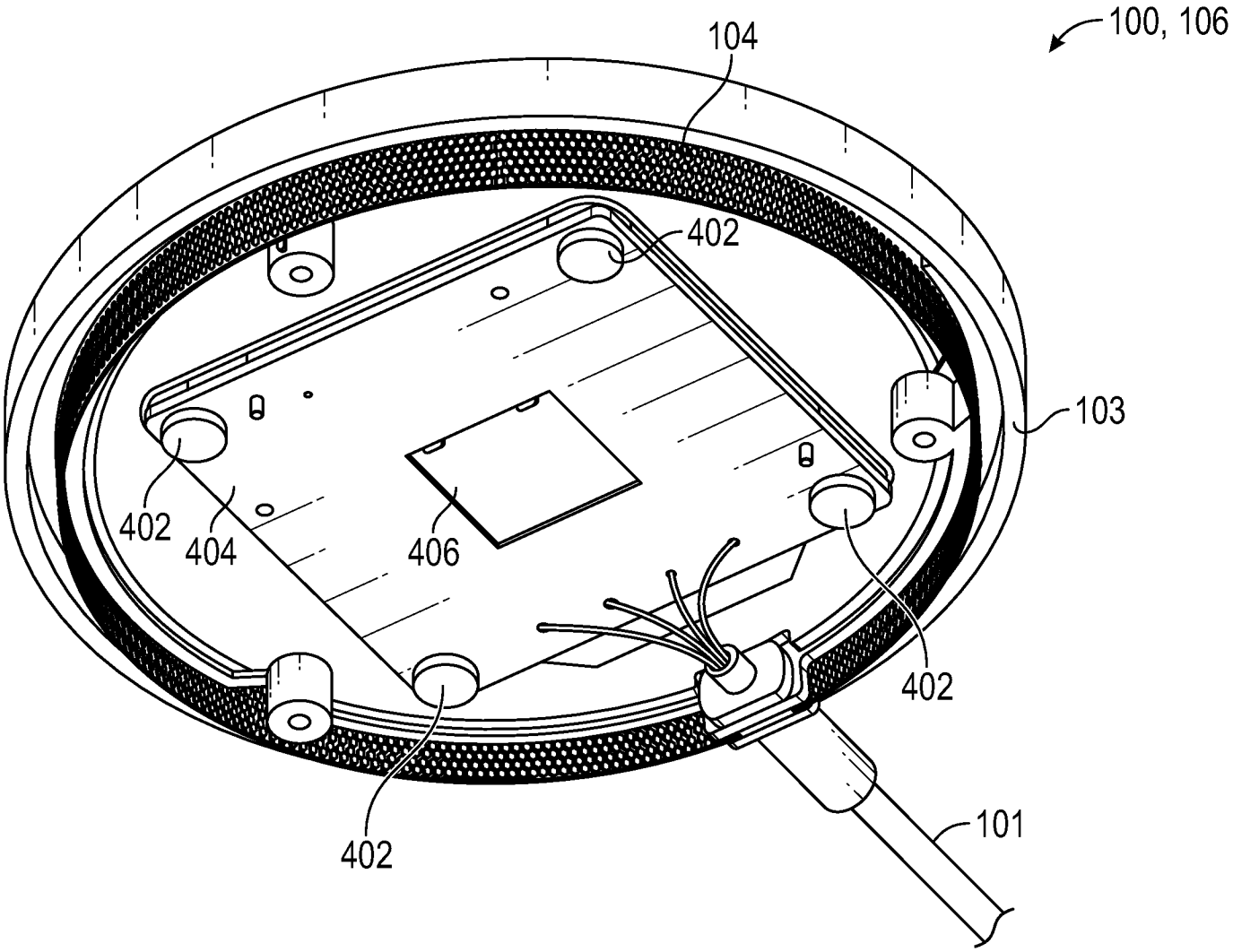
FIG. 5A shows an exemplary sub-assembly of the embodiment of FIG. 1 in a perspective view.
Figure 5B:
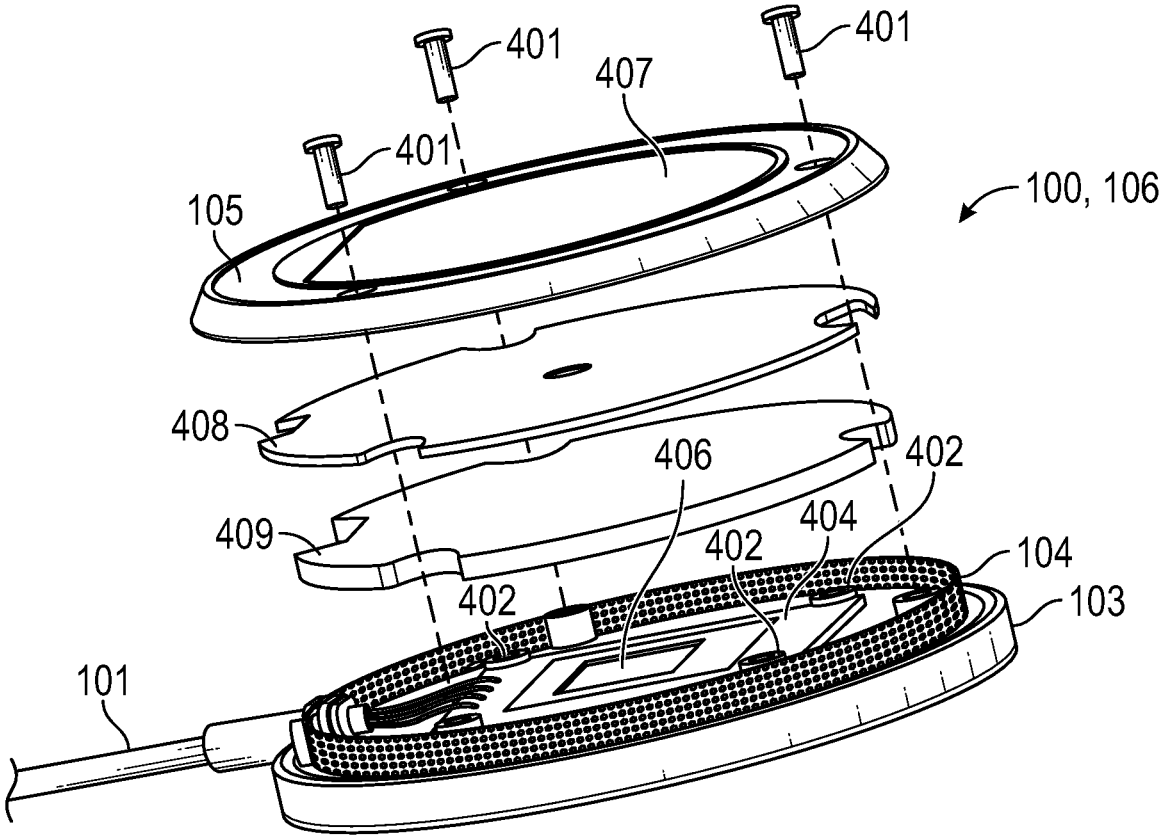
FIG. 5B shows the embodiment of FIG. 1 in a partially exploded view.

The sub-assembly of FIG. 5A may then be connected to the remaining components of the microphone pod 100. This can be seen, e.g., from FIG. 4 or FIG. 5B, the latter of which shows the connection of bottom cover 105, base bottom cover 408 made of metal to add weight, and melamine foam disc 409 to the top cover 103 using the fasteners 401. As will be apparent from FIG. 4, a ring-shaped rubber foot 410 and a serial/data label 407 may be mounted on an outer side of bottom cover 105.

Figure 5C:
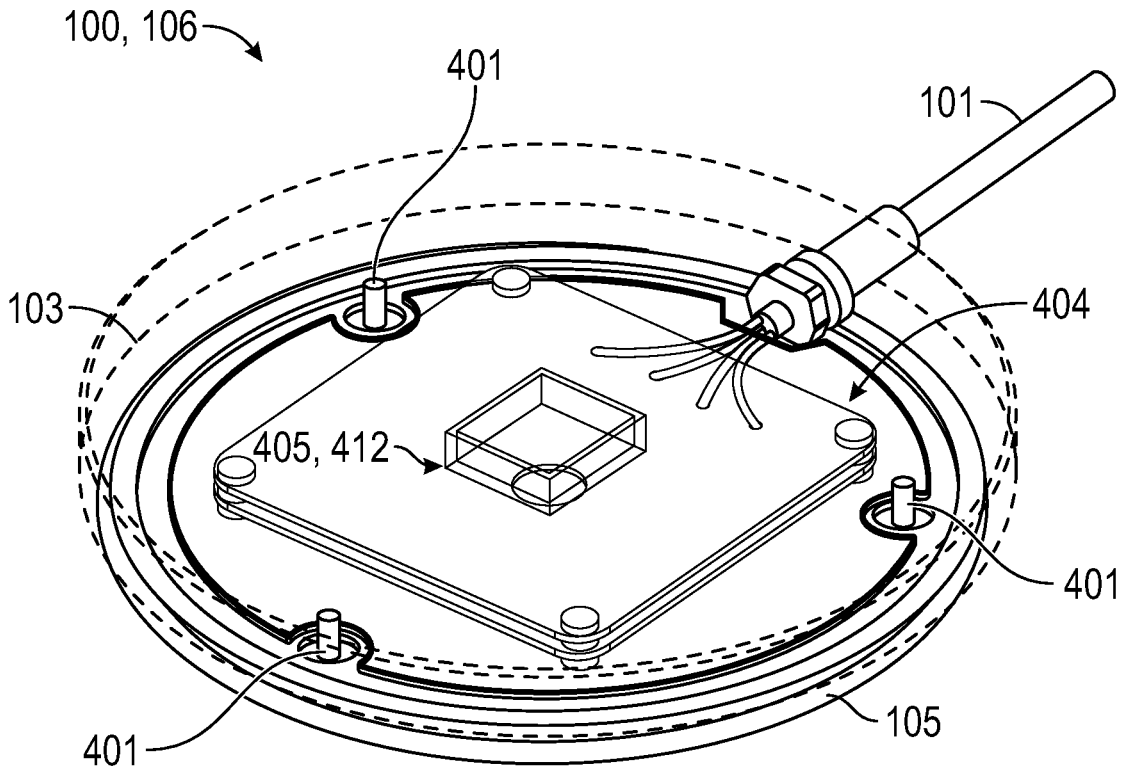
FIG. 5C shows the embodiment of FIG. 1 in a part-transparent, perspective view.
Figure 5D:
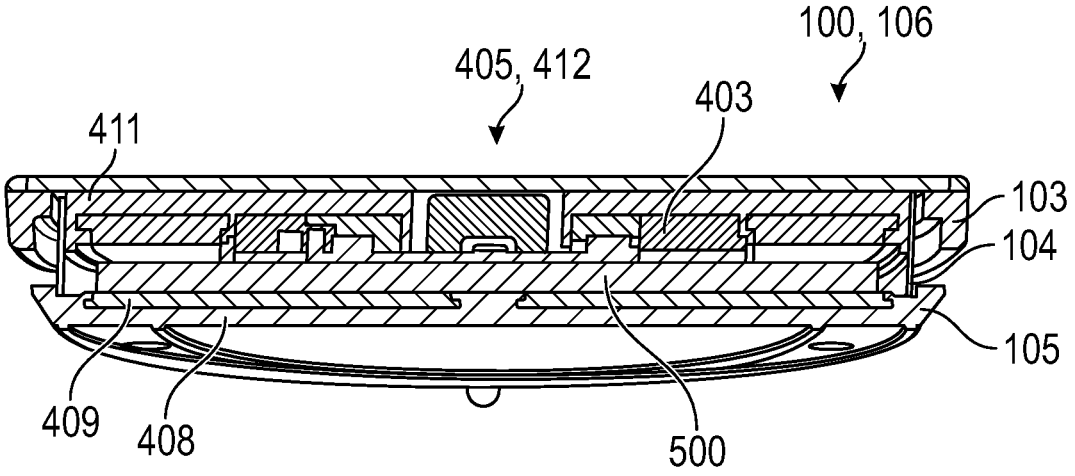
FIG. 5D shows a cross-sectional view of the embodiment of FIG. 1.

The resulting microphone pod 100 is shown in the part-transparent, perspective view of FIG. 5C as well as the cross-sectional view of FIG. 5D.

As will be apparent in particular from FIG. 5D, the setup results in that the microphone 406 (not shown in FIG. 5D) is located in an interior transparent acoustical chamber 500 just slightly above the melamine foam disc 409, providing a boundary microphone-like setup. The melamine foam disc 409 serves as a frequency-selective attenuator, i.e., in this embodiment a high frequency acoustic filter.

Melamine foam disc 409 used in this embodiment in particular reduces 'seashell noise' at higher frequencies. Melamine foam provides ease of tuning for correct equalization. Also the melamine foam reduces the acoustic internal reflections from the grille 104.

As will be apparent in particular from FIG. 5D, the wall of the bottom cover 105 of the microphone pod 100, forming the pod chamber with the top cover 103, is rigid and thick enough to avoid acoustic artefacts. The thickness of bottom cover 105 may, e.g., be in the range of 1.5-2 mm to allow for a particularly good acoustic coupling of the microphone 406 to the tabletop surface.

The exemplary microphone pod 100 discussed herein provides a highly uniform polar response with little amplitude or shadowing artifacts, as can be seen from the polar diagrams of FIGS. 7 through 11. The FIGS. shows scans of the inventive microphone pods described herein (referred to as "Kepler") as compared to prior art extension microphones (referred to as "Trio8800 ExMic"). The measurements are with an unequalized sound field, but are compared to a flat B&K reference mic response. As shown in these scans, the inventive microphone pods described herein have much less coloring of the sound for amplitude versus frequency versus angle.

In sum, the exemplary microphone pods described herein provide for a number of benefits over prior art extension microphones. Specifically, the microphone pods described herein provide for near perfect polar amplitude and frequency response for minimal coloring of a talker's voice regardless of position. Additionally, the microphone pods described herein ensure an internal MEMS microphone is protected from dust and other environmental hazards. Further, the microphone pods described herein minimize frequency combing and/or table reflections. Still yet, the microphone pods described herein mitigate the acoustic effects of a mute button thereon being pressed.

While the exemplary embodiments of the present invention are described and illustrated herein, it will be appreciated that they are merely illustrative and that modifications can be made to these embodiments without departing from the spirit and scope of the invention.

Thus, the scope of the invention is intended to be defined only in terms of the following claims as may be amended, with each claim being expressly incorporated into this description as an embodiment of the invention.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit may fulfill the functions of several items recited in the claims.

The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

What is claimed is:

1. A tabletop microphone assembly, comprising at least:

a housing with a top cover and a bottom cover, wherein the bottom cover is configured for placement on a table surface;

a printed circuit board, arranged in the housing between the top cover and the bottom cover; and a microphone, arranged between the printed circuit board and the bottom cover; wherein the microphone is facing the bottom cover.

2. The microphone assembly of claim 1, wherein the microphone is a micro-electromechanical system (MEMS) microphone.

3. The microphone assembly of claim 1, wherein the microphone is arranged at a distance of a maximum of 3 mm from the bottom cover.

4. The microphone assembly of claim 1, wherein the housing has a cylindrical shape and comprises a longitudinal axis, the longitudinal axis being arranged perpendicular to the top cover and the bottom cover.

5. The microphone assembly of claim 4, wherein the microphone is arranged on the longitudinal axis.

6. The microphone assembly of claim 4, wherein the housing further comprises a grille, arranged between the top cover and the bottom cover near a circumference of the housing.

7. The microphone assembly of claim 6, wherein the top cover, the bottom cover, and the grille form a transparent acoustical chamber.

8. The microphone assembly of claim 1, wherein at least one of the top cover and the bottom cover are disc-shaped.

9. The microphone assembly of claim 1, further comprising a frequency-selective attenuator, arranged on an inside of the bottom cover.

10. The microphone assembly of claim 9, wherein the frequency-selective attenuator is disc-shaped.

11. The microphone assembly of claim 9, wherein the frequency-selective attenuator comprises at least a layer of melamine foam.

12. The microphone assembly of claim 1, wherein bottom cover is made from a high-density material.

13. The microphone assembly of claim 1, wherein the microphone is mounted on a first side of the printed circuit board, wherein the microphone assembly further comprises a user interface, arranged on a second side of the printer circuit board, opposite to the first side.

14. The microphone assembly of claim 13, wherein the user interface comprises at least a mute control that allows to selectively mute the microphone.

15. The microphone assembly of claim 1, configured as a tabletop microphone pod.

16. The microphone assembly of claim 1, configured as an extension microphone for a conference system.

17. A conferencing system, comprising at least one or more tabletop microphone assemblies, wherein the one or more tabletop microphone assemblies each comprise at least:

a housing with a top cover and a bottom cover, wherein the bottom cover is configured for placement on a table surface;

a printed circuit board, arranged in the housing between the top cover and the bottom cover; and a microphone, arranged between the printed circuit board and the bottom cover; wherein the microphone is facing the bottom cover.

18. The conferencing system of claim 17, wherein the conferencing system is a video conferencing system further comprising one or more cameras, one or more video playback devices, and a network interface for communicating with at least one remote conferencing participant.

19. A tabletop microphone assembly, comprising at least:

a housing with a top cover, a bottom cover, and a grille, wherein the bottom cover is configured for placement on a table surface and the grille is arranged between the top cover and the bottom cover near a circumference of the housing;

a printed circuit board, arranged in the housing; and a microphone, arranged between the printed circuit board and the bottom cover; wherein the microphone is facing the bottom cover; wherein the top cover, the bottom cover, and the grille form a transparent acoustical chamber for the microphone.

* * * * *